US012601491B2

(12) United States Patent
Tully et al.

(10) Patent No.: US 12,601,491 B2
(45) Date of Patent: Apr. 14, 2026

(54) COMBUSTOR HAVING SECONDARY FUEL INJECTOR

(71) Applicant: Siemens Energy Global GmbH & Co. KG, Munich (DE)

(72) Inventors: Landon Tully, Charlotte, NC (US); Walter Ray Laster, Oviedo, FL (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 18/868,810

(22) PCT Filed: Apr. 26, 2023

(86) PCT No.: PCT/US2023/019980
§ 371 (c)(1),
(2) Date: Nov. 25, 2024

(87) PCT Pub. No.: WO2023/235078
PCT Pub. Date: Dec. 7, 2023

(65) Prior Publication Data

US 2025/0347414 A1 Nov. 13, 2025

Related U.S. Application Data

(60) Provisional application No. 63/347,725, filed on Jun. 1, 2022.

(51) Int. Cl.
*F23R 3/34* (2006.01)
*F01D 9/02* (2006.01)
(Continued)

(52) U.S. Cl.
CPC ..... *F23R 3/34* (2013.01); *F01D 9/023* (2013.01); *F23R 3/14* (2013.01); *F23R 3/28* (2013.01)

(58) Field of Classification Search
CPC .... F23R 3/34; F23R 3/346; F23R 3/14; F23R 3/16; F23R 3/28; F23R 3/286; F01D 9/023
See application file for complete search history.

(56) References Cited

U.S. PATENT DOCUMENTS 9,534,790 B2 * 1/2017 Cai ..... F23R 3/346
9,551,490 B2 * 1/2017 DiCintio ..... B22F 5/10
(Continued)

FOREIGN PATENT DOCUMENTS

CN 112944395 A 6/2021
CN 113310071 A 8/2021
JP 2006010193 A 1/2006

OTHER PUBLICATIONS

PCT International Search Report and Written Opinion of International Searching Authority mailed Oct. 30, 2023 corresponding to PCT International Application No. PCT/US2023/019980 filed Apr. 26, 2023.

*Primary Examiner* — William H Rodriguez

(57) ABSTRACT

A combustor includes a transition duct having a transition duct liner defining an opening that extends through the transition duct liner, a secondary fuel injector disposed in the opening. The secondary fuel injector has an inner shell arranged to define an inner space; an outer shell cooperating with the inner shell to define an outer space that is annular; a plurality of inner flow guides positioned within the inner space and arranged around the inner shell, each inner flow guide arranged to turn a first mixture of fuel and air in one of a clockwise and counterclockwise direction around the inner shell, a plurality of outer flow guides positioned within the outer space and arranged around the inner shell, each outer flow guide arranged to turn a second mixture of fuel and air in the other of the clockwise and counterclockwise direction around the inner shell.

19 Claims, 4 Drawing Sheets

(51) Int. Cl.
*F23R 3/14* (2006.01)
*F23R 3/28* (2006.01)

(56) References Cited

U.S. PATENT DOCUMENTS

| | | | | |
|---|---|---|---|---|
| 9,797,601 | B2 * | 10/2017 | Cheung | B01F 23/20 |
| 2014/0116053 | A1 * | 5/2014 | Chen | F23R 3/346 60/737 |
| 2014/0123665 | A1 | 5/2014 | Wood | |
| 2014/0190170 | A1 * | 7/2014 | Cai | F23R 3/346 60/746 |
| 2014/0196465 | A1 * | 7/2014 | Laster | F23R 3/346 60/737 |
| 2015/0052905 | A1 * | 2/2015 | Carnell, Jr. | F02C 9/28 60/734 |
| 2015/0167980 | A1 * | 6/2015 | Pent | F23R 3/46 60/746 |
| 2015/0276226 | A1 * | 10/2015 | Laster | F23R 3/34 60/731 |
| 2015/0285501 | A1 * | 10/2015 | DiCintio | F23R 3/346 60/740 |
| 2015/0285504 | A1 * | 10/2015 | Melton | B23K 26/702 60/737 |
| 2016/0258627 | A1 | 9/2016 | Cheung | |
| 2017/0114717 | A1 * | 4/2017 | Martin | F02C 7/22 |
| 2017/0219212 | A1 * | 8/2017 | Laster | F02C 3/30 |
| 2018/0003387 | A1 | 1/2018 | Cheung | |
| 2018/0039254 | A1 * | 2/2018 | North | B33Y 50/00 |
| 2018/0187563 | A1 * | 7/2018 | Laster | F23R 3/425 |
| 2018/0313535 | A1 * | 11/2018 | North | F23R 3/20 |
| 2019/0226680 | A1 * | 7/2019 | North | F23R 3/34 |
| 2019/0301738 | A1 * | 10/2019 | North | F23R 3/286 |
| 2024/0377066 | A1 * | 11/2024 | Sharma | F23R 3/286 |

* cited by examiner

COMBUSTOR HAVING SECONDARY FUEL INJECTOR

BACKGROUND

A gas turbine engine typically includes a compressor section, a turbine section, and a combustion section disposed therebetween. The compressor section includes multiple stages of rotating compressor blades and stationary compressor vanes. The combustion section typically includes a plurality of combustors. The turbine section includes multiple stages of rotating turbine blades and stationary turbine vanes.

The combustor may include fuel injectors for providing a fuel to be mixed with compressed air from the compressor section and an ignition source for igniting the mixture to form hot exhaust gas for the turbine section. Gas turbine combustion can produce undesirable emissions including unburnt hydrocarbons. In addition, operation at higher temperatures results in higher efficiency. It is therefore desirable to operate at the highest temperature possible and to assure thorough combustion within the combustor.

BRIEF SUMMARY

In one aspect, a combustor includes a transition duct having a transition duct liner defining an opening that extends through the transition duct liner; and a secondary fuel injector disposed in the opening. The secondary fuel injector includes an inner shell arranged to define an inner space; an outer shell cooperating with the hand inner shell to define an outer space that is annular; a plurality of inner flow guides positioned within the inner space and arranged around the inner shell, each inner flow guide of the plurality of inner flow guides arranged to turn a first mixture of fuel and air in one of a clockwise and counterclockwise direction around the inner shell; and a plurality of outer flow guides positioned within the outer space and arranged around the inner shell, each outer flow guide of the plurality of outer flow guides arranged to turn a second mixture of fuel and air in the other of the clockwise and counterclockwise direction around the inner shell.

In one aspect, a combustor includes a transition duct having a transition duct liner defining an opening that extends through the transition duct liner; and a secondary fuel injector disposed in the opening. The secondary fuel injector includes an inner shell arranged to define an inner space; an outer shell cooperating with the inner shell to define an outer space that is annular; a plurality of inner flow guides positioned within the inner space and arranged around the inner shell, the plurality of inner flow guides arranged to turn a first mixture of fuel and air in one of a clockwise and counterclockwise direction around the inner shell, each inner flow guide of the plurality of inner flow guides including an airfoil shape having an inner flow guide pressure side wall and an inner flow guide suction side wall; and a plurality of outer flow guides positioned within the outer space and arranged around the inner shell, the plurality of outer airfoils arranged to turn a second mixture of fuel and air in the other of the clockwise and counterclockwise direction around the inner shell, each outer flow guide of the plurality of outer flow guides having an airfoil shape having an outer flow guide pressure side wall and an outer flow guide suction side wall.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
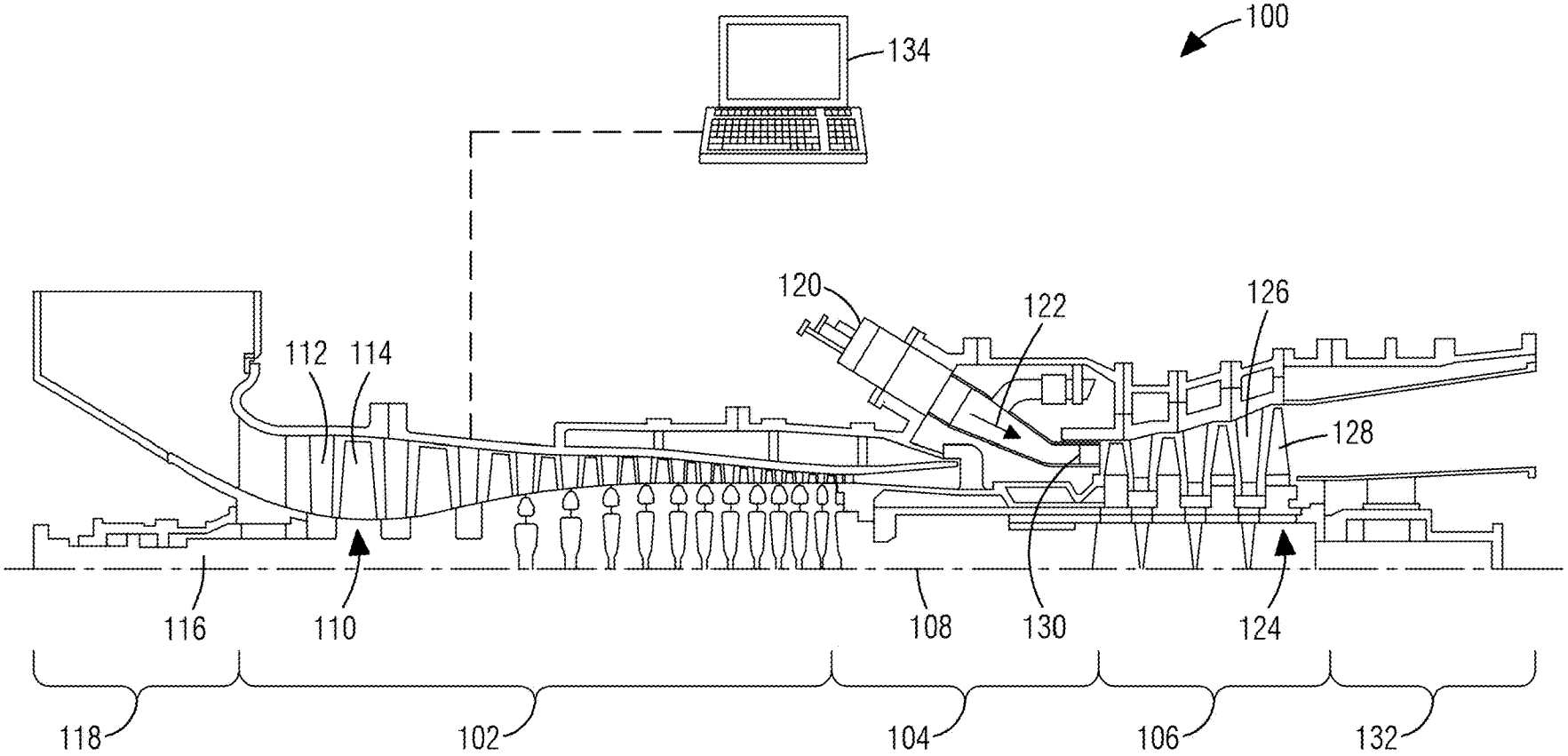
FIG. 1 is a longitudinal cross-sectional view of a gas turbine engine taken along a plane that contains a longitudinal axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an", and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

Also, in the description, the terms "axial" or "axially" refer to a direction along a longitudinal axis of a gas turbine engine. The terms "radial" or "radially" refer to a direction perpendicular to the longitudinal axis of the gas turbine engine. The terms "downstream" or "aft" refer to a direction along a flow direction. The terms "upstream" or "forward" refer to a direction against the flow direction.

In addition, the term "adjacent to" may mean that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 104, and a turbine section 106 arranged along a longitudinal axis 108. The compressor section 102 includes a plurality of compressor stages 110 with each compressor stage 110 including a set of stationary vanes 112 or adjustable guide vanes and a set of rotating blades 114. A rotor 116 supports the rotating blades 114 for rotation about the longitudinal axis 108 during operation. In some constructions, a single one-piece rotor 116 extends the length of the gas turbine engine 100 and is supported for rotation by a bearing at either end. In other constructions, the rotor 116 is assembled from several separate spools that are attached to one another or may include multiple disk sections that are attached via a bolt or plurality of bolts.

The compressor section 102 is in fluid communication with an inlet section 118 to allow the gas turbine engine 100 to draw atmospheric air into the compressor section 102. During operation of the gas turbine engine 100, the compressor section 102 draws in atmospheric air and compresses that air for delivery to the combustion section 104. The illustrated compressor section 102 is an example of one compressor section 102 with other arrangements and designs being possible.

In the illustrated construction, the combustion section 104 includes a plurality of separate combustors 120 that each operate to mix a flow of fuel with the compressed air from the compressor section 102 and to combust that air-fuel mixture to produce a flow of high temperature, high pressure combustion gases or exhaust gas 122. Of course, many other arrangements of the combustion section 104 are possible.

The turbine section 106 includes a plurality of turbine stages 124 with each turbine stage 124 including a number of stationary turbine vanes 126 and a number of rotating turbine blades 128. The turbine stages 124 are arranged to receive the exhaust gas 122 from the combustion section 104 at a turbine inlet 130 and expand that gas to convert thermal and pressure energy into rotating or mechanical work. The turbine section 106 is connected to the compressor section 102 to drive the compressor section 102. For gas turbine engines 100 used for power generation or as prime movers, the turbine section 106 is also connected to a generator, pump, or other device to be driven. As with the compressor section 102, other designs and arrangements of the turbine section 106 are possible.

An exhaust portion 132 is positioned downstream of the turbine section 106 and is arranged to receive the expanded flow of exhaust gas 122 from the final turbine stage 124 in the turbine section 106. The exhaust portion 132 is arranged to efficiently direct the exhaust gas 122 away from the turbine section 106 to assure efficient operation of the turbine section 106. Many variations and design differences are possible in the exhaust portion 132. As such, the illustrated exhaust portion 132 is but one example of those variations.

A control system 134 is coupled to the gas turbine engine 100 and operates to monitor various operating parameters and to control various operations of the gas turbine engine 100. In preferred constructions the control system 134 is typically micro-processor based and includes memory devices and data storage devices for collecting, analyzing, and storing data. In addition, the control system 134 provides output data to various devices including monitors, printers, indicators, and the like that allow users to interface with the control system 134 to provide inputs or adjustments. In the example of a power generation system, a user may input a power output set point and the control system 134 may adjust the various control inputs to achieve that power output in an efficient manner.

The control system 134 can control various operating parameters including, but not limited to variable inlet guide vane positions, fuel flow rates and pressures, engine speed, valve positions, generator load, and generator excitation. Of course, other applications may have fewer or more controllable devices. The control system 134 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
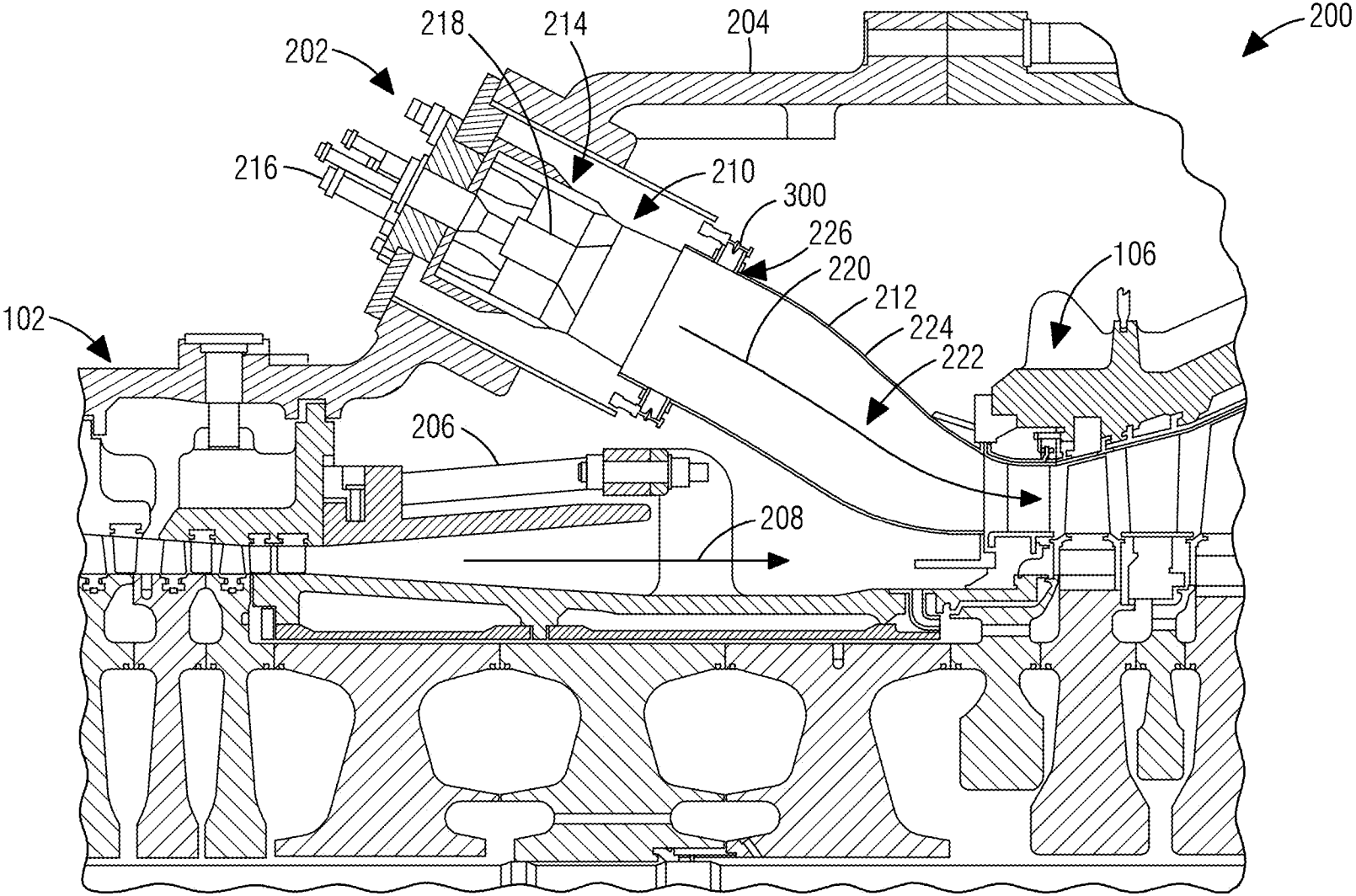
FIG. 2 is a longitudinal cross-sectional view of a combustion section of the gas turbine engine shown in FIG. 1.

FIG. 2 illustrates a longitudinal cross-sectional view of a combustion section 200 suitable for use in the gas turbine engine 100 of FIG. 1. The combustion section 200 may replace the combustion section 104 of FIG. 1.

The combustion section 200 includes a casing 204 and a combustor 202 that is enclosed by the casing 204. A plurality of combustors 202 are arranged circumferentially around the longitudinal axis 108 of the gas turbine engine 100 and spaced apart from each other to define a can-type combustor, with other arrangements being possible. The plurality of combustors 202 are enclosed by the casing 204. A compressor exit diffusor 206 is connected to the exit of the compressor section 102 for providing compressed air 208 to the combustor 202.

Each combustor 202 of the plurality of combustors 202 includes a head-end section 210 that is connected to a transition duct 212. The head-end section 210 includes a primary fuel injector 214 that includes a primary fuel supply tube 216 and a pilot burner 218. The primary fuel supply tube 216 injects fuel to the combustor 202. The fuel is mixed with the compressed air 208 and is ignited by the pilot burner 218 for producing an exhaust gas 220.

The transition duct 212 has a transition duct liner 224 that encloses an interior defining a combustion chamber 222 therein through which the exhaust gas 220 passes. The exit of the transition duct 212 is connected to the entrance of the turbine section 106 such that the exhaust gas 220 enters the turbine section 106. The transition duct liner 224 defines a plurality of openings 226 that are disposed circumferentially around the transition duct 212 and spaced apart from each other. Each opening 226 of the plurality of openings 226 extends through the transition duct liner 224.

The combustor 202 includes a plurality of secondary fuel injectors 300 that are arranged downstream of the primary fuel injector 214 and at an upstream side of the transition duct 212. Each secondary fuel injector 300 of the plurality of secondary fuel injectors 300 is disposed in one opening 226 of the plurality of openings 226.

Figure 3:
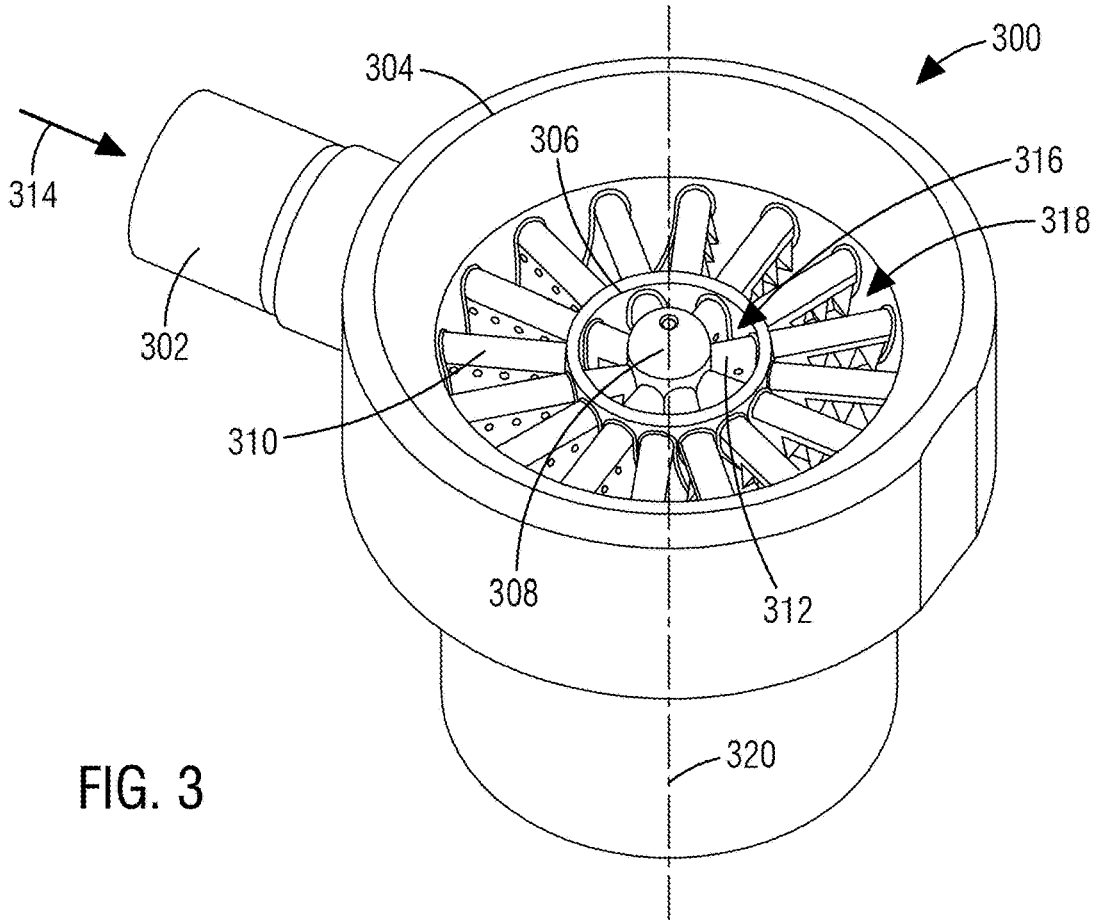
FIG. 3 is a perspective view of a secondary fuel injector shown in FIG. 2.

FIG. 3 illustrates a perspective view of one secondary fuel injector 300 of the plurality of secondary fuel injectors 300 shown in FIG. 2. The secondary fuel injector 300 includes a fuel supply tube 302, an outer shell 304, an inner shell 306, and a central hub 308. The fuel supply tube 302 connects the secondary fuel injector 300 to a fuel plenum ring (not shown) to provide a flow of secondary fuel 314 to the secondary fuel injector 300. The fuel supply tube 302 is attached to the outer shell 304.

The inner shell 306 has a general cylindrical shape and defines an inner space 316 therein. The central hub 308 is disposed at a center of the inner space 316. The outer shell 304 has a general cylindrical shape and is disposed around the inner shell 306. An outer space 318 has an annular shape that is defined between the outer shell 304 and the inner shell 306. The outer shell 304, the inner shell 306, and the central hub 308 are concentric along a central axis 320. A radius of the central hub 308 is between 10% to 90% of a radius of the inner shell 306. In other constructions, the central hub 308 may have a radius that is not between 10% to 90% of the radius of the inner shell 306.

The secondary fuel injector 300 includes a plurality of inner flow guides 312 that are positioned within the inner space 316. The plurality of inner flow guides 312 are arranged around the inner shell 306 and spaced apart from each other. The plurality of inner flow guides 312 are positioned between the central hub 308 and the inner shell 306. An inner span length of each inner flow guide 312 is a distance between the inner shell 306 and the central hub 308. In constructions that do not have the central hub 308, the inner span length of each inner flow guide 312 is a distance between the inner shell 306 and a center of the inner space 316.

The secondary fuel injector 300 includes a plurality of outer flow guides 310 that are positioned within the outer space 318. The plurality of outer flow guides 310 are arranged around the inner shell 306 and spaced apart from each other. An outer span length of each outer flow guide 310 is a distance between the outer shell 304 and the inner shell 306. The inner span length is less than the outer span length. In other constructions, the inner span length may be greater than or equal to the outer span length.

A quantity of the outer flow guides 310 is more than a quantity of the inner flow guides 312. In the construction shown in FIG. 3, the quantity of the outer flow guides 310 is twice the quantity of the inner flow guides 312. In other constructions, the ratio of the quantity of the outer flow guides 310 to the quantity of the inner flow guides 312 may be greater or less than two.

Figure 4:
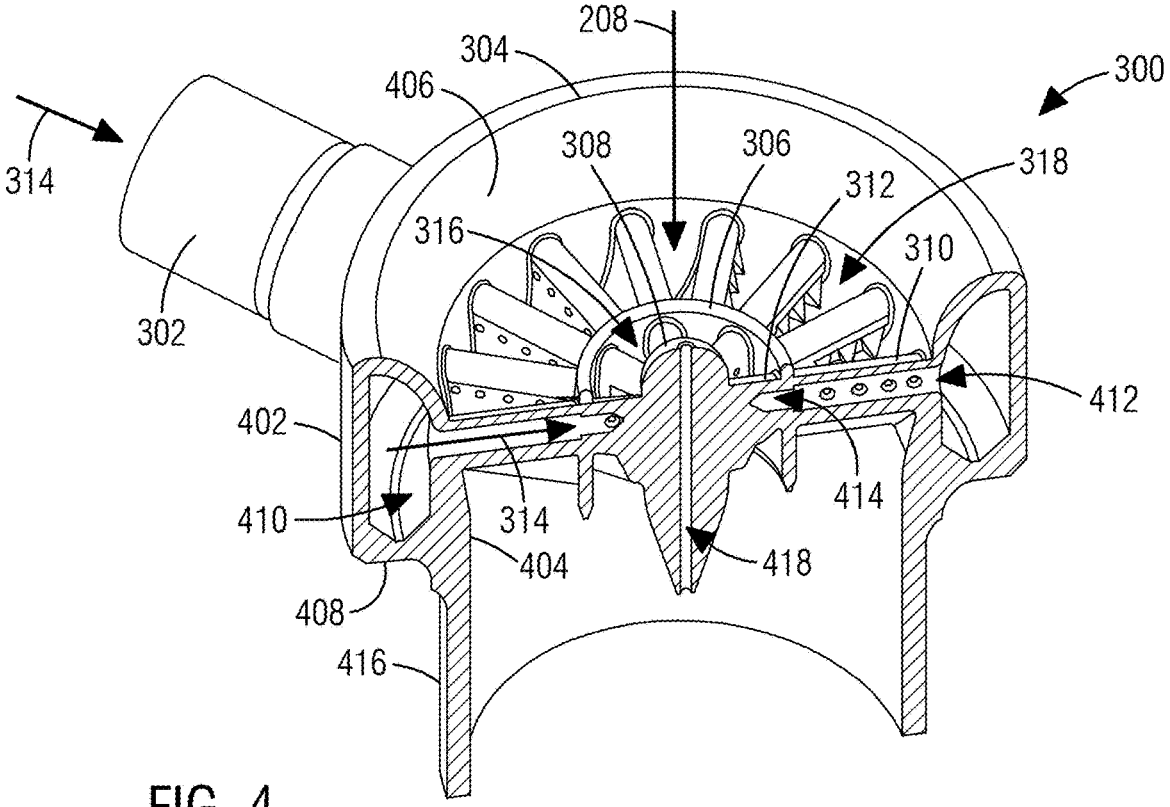
FIG. 4 is a perspective cut away view of the secondary fuel injector shown in FIG. 3.

FIG. 4 illustrates a perspective cut away view of the secondary fuel injector 300 shown in FIG. 3. The outer shell 304 has an outer wall 402, an inner wall 404, a first side wall 406, and a second side wall 408. The first side wall 406 and the second side wall 408 are disposed between the outer wall 402 and the inner wall 404. The first side wall 406 is tapered from the outer wall 402 to the inner wall 404 toward the transition duct 212. A hollow outer shell interior 410 is defined by the outer wall 402, the inner wall 404, the first side wall 406, and the second side wall 408.

Each outer flow guide 310 of the plurality of outer flow guides 310 has a hollow outer flow guide interior 412 that is in flow connection with the hollow outer shell interior 410. Each inner flow guide 312 of the plurality of inner flow guides 312 has a hollow inner flow guide interior 414 that is in flow connection with one hollow outer flow guide interior 412 of one outer flow guide 310 of the plurality of outer flow guides 310.

The secondary fuel injector 300 includes a mixing tube 416 that extends from the inner wall 404 toward the transition duct 212. The secondary fuel 314 and the compressed air 208 is mixed in the mixing tube 416 to produce a mixture of fuel and air. The central hub 308 includes a purge air channel 418 to prevent flame holding on the tip of the central hub 308. The mixture of fuel and air exits the secondary fuel injector 300 and enters the combustion chamber 222 where the mixture of fuel and air is ignited as it mixes with the exhaust gas 220 from the head-end section 210 of the combustor 202.

Figure 5:
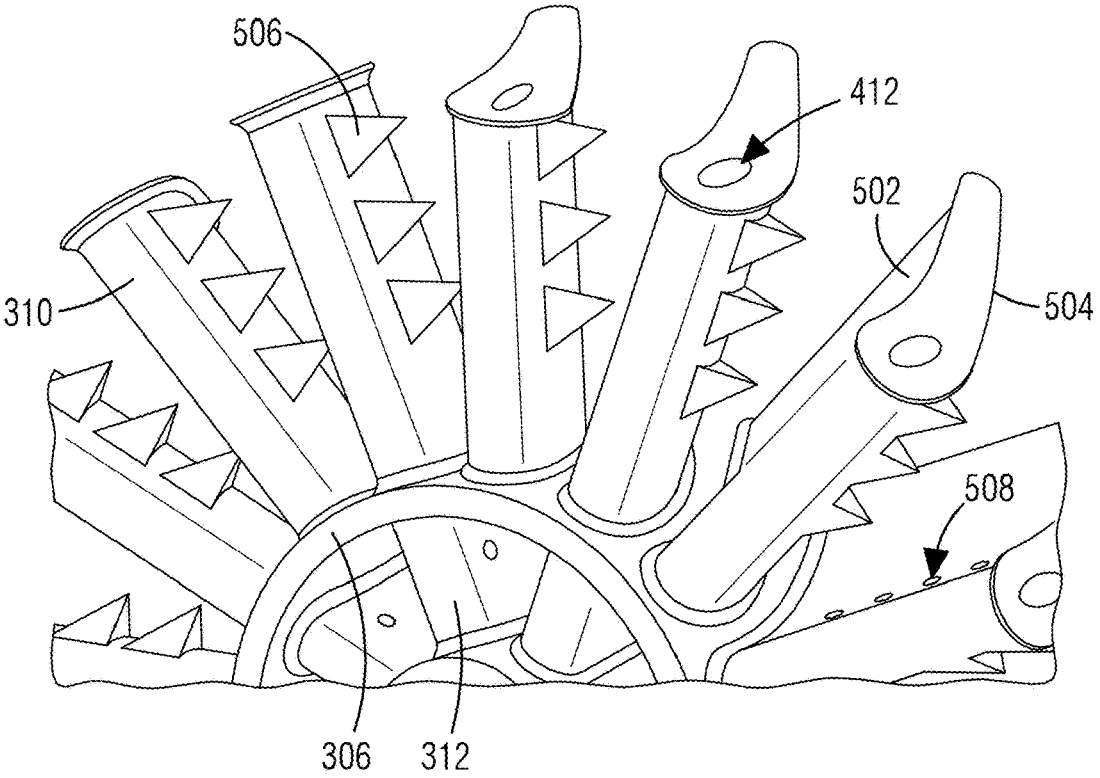
FIG. 5 is a portion of the perspective view of the secondary fuel injector shown in FIG. 3 that better illustrates a plurality of outer flow guides.

FIG. 5 illustrates a portion of the perspective view of the secondary fuel injector 300 shown in FIG. 3 that better illustrates the plurality of outer flow guide 310. Bach outer flow guide 310 has an airfoil shape having an outer flow guide pressure side wall 502 and an outer flow guide suction side wall 504. The hollow outer flow guide interior 412 is defined between the outer flow guide pressure side wall 502 and the outer flow guide suction side wall 504. In the construction shown in FIG. 5, each outer flow guide pressure side wall 502 and each outer flow guide suction side wall 504 are curved with the curvature arranged to turn a flow that passes between adjacent outer flow guides 310 in a counterclockwise direction around the inner shell 306 with respect to the central axis 320 of the secondary fuel injector 300. In other constructions, each outer flow guide pressure side wall 502 and each outer flow guide suction side wall 504 may be curved with the curvature arranged to turn a flow that passes between adjacent outer flow guides 310 in a clockwise direction around the inner shell 306 with respect to the central axis 320 of the secondary fuel injector 300.

Each outer flow guide 310 has at least one outer flow guide fuel outlet 508 that is defined at one side wall of the outer flow guide fuel outlet 508. In the construction shown in FIG. 5, each outer flow guide 310 has four outer flow guide fuel outlets 508 that are defined at the outer flow guide pressure side wall 502. In other constructions, each outer flow guide 310 may have greater or less than four outer flow guide fuel outlets 508 that are defined at the outer flow guide pressure side wall 502 and/or at least one outer flow guide fuel outlet 508 may be defined at the outer flow guide suction side wall 504.

The secondary fuel injector 300 has a plurality of outer vortex generators 506. At least one outer vortex generator 506 of the plurality of outer vortex generators 506 is attached to one side wall of one outer flow guide 310 and protrudes out from the one side wall. In the construction shown in FIG. 5, three outer vortex generators 506 are attached to the outer flow guide suction side wall 504 of each outer flow guide 310. The outer vortex generator 506 has a general prismatic shape. In other constructions, a quantity of the outer vortex generators 506 that are attached to the outer flow guide suction side wall 504 may be greater or less than three and/or the outer vortex generator 506 may be attached to the outer flow guide pressure side wall 502 and/or the outer vortex generator 506 may have different geometries. It is also possible that at least one outer flow guide 310 has no outer vortex generator 506 attached to.

Figure 6:
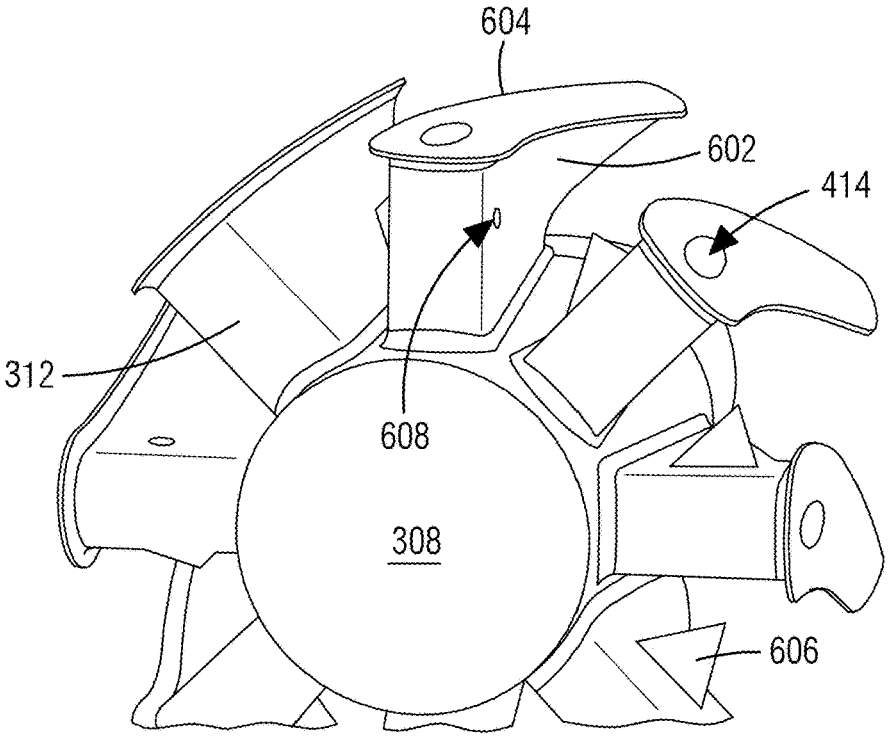
FIG. 6 is a portion of the perspective view of the secondary fuel injector shown in FIG. 3 that better illustrates a plurality of inner flow guides.

FIG. 6 illustrates a portion of the perspective view of the secondary fuel injector 300 shown in FIG. 3 that better illustrates the plurality of inner flow guide 312. Each inner flow guide 312 has an airfoil shape having an inner flow guide pressure side wall 602 and an inner flow guide suction side wall 604. The hollow inner flow guide interior 414 is defined between the inner flow guide pressure side wall 602 and the inner flow guide suction side wall 604. In the construction shown in FIG. 6, each inner flow guide pressure side wall 602 and each inner flow guide suction side wall 604 are curved with the curvature turning to turn a flow that passes between adjacent inner flow guides 312 in a clockwise direction around the inner shell 306 with respect to the central axis 320 of the secondary fuel injector 300. In other constructions, each inner flow guide pressure side wall 602 and each inner flow guide suction side wall 604 may be curved with the curvature turning to turn a flow that passes between adjacent inner flow guides 312 in a counterclockwise direction around the inner shell 306 with respect to the central axis 320 of the secondary fuel injector 300.

Each inner flow guide 312 has at least one inner flow guide fuel outlet 608 that is defined at one side wall of the inner flow guide 312. In the construction shown in FIG. 6, each inner flow guide 312 has one inner flow guide fuel outlet 608 that is defined at the inner flow guide pressure side wall 602. In other constructions, each inner flow guide 312 may have more than one inner flow guide fuel outlet 608 that are defined at the inner flow guide pressure side wall 602 and/or at least one inner flow guide fuel outlet 608 may be defined at the inner flow guide suction side wall 604.

The secondary fuel injector 300 has a plurality of inner vortex generators 606. At least one inner vortex generator 606 of the plurality of inner vortex generators 606 is attached to one side wall of the inner flow guide 312 and protrudes out from the one side wall. In the construction shown in FIG. 6, one inner vortex generator 606 is attached to the inner flow guide suction side wall 604 of each inner flow guide 312. The inner vortex generator 606 has a general prismatic shape. In other constructions, a quantity of the inner vortex generators 606 that are attached to the inner flow guide suction side wall 604 may be more than one and/or the inner vortex generator 606 may be attached to the inner flow guide pressure side wall 602 and/or the inner vortex generator 606 may have different geometries. It is also possible that at least one inner flow guide 312 has no inner vortex generator 606 attached to.

With reference to FIG. 5 and FIG. 6, the plurality of outer flow guides 310 and the plurality of inner flow guides 312 are arranged in a way such that the outer flow guide pressure side walls 502 and the inner flow guide pressure side walls 602 turn the flow passing therethrough in opposite circumferential directions. In the construction shown in FIG. 5 and FIG. 6, the outer flow guide pressure side walls 502 turn the flow passing therethrough in the counterclockwise direction around the inner shell 306, the inner flow guide pressure side walls 602 turn the flow passing therethrough in the clockwise direction around the inner shell 306. In other constructions, the outer flow guide pressure side walls 502 may turn the flow passing therethrough in the clockwise direction and the inner flow guide pressure side walls 602 may turn the flow passing therethrough in the counterclockwise direction.

In operation, with reference to FIG. 1 through FIG. 6, the secondary fuel 314 is provide from a fuel plenum ring (not shown) to the fuel supply tube 302 and enters the hollow outer shell interior 410. The secondary fuel 314 is then provided to the plurality of outer flow guides 310 through the hollow outer flow guide interiors 412 where a portion of that fuel exits the outer flow guides 310 and enters the outer space 318 through the outer flow guide fuel outlets 508. The remainder of the secondary fuel 314 flows to the plurality of inner flow guides 312 through the hollow inner flow guide interiors 414 and exits the inner flow guides 312 into the inner space 316 through the inner flow guide fuel outlets 608.

The compressed air 208 enters the inner space 316 and is mixed with the secondary fuel 314 in the inner space 316 forming a first mixture of fuel and air. The compressed air 208 enters the outer space 318 and is mixed with the secondary fuel 314 in the outer space 318 forming a second mixture of fuel and air. The first mixture of fuel and air is swirled by the arrangement of the plurality of inner flow guide 312 and turns in one of the clockwise and counterclockwise direction around the inner shell 306 to improve the mixing in the inner space 316. The second mixture of fuel and air is swirled by the arrangement of the plurality of outer flow guides 310 and turns in the other of the clockwise and counterclockwise direction around the inner shell 306 to improve the mixing in the outer space 318. The first mixture of fuel and air and the second mixture of fuel and air are mixed together in the mixing tube 416 before exiting the secondary fuel injector 300. By turning the first mixture of fuel and air in the inner space 316 and the second mixture of fuel and air in the outer space 318 in opposite clockwise and counterclockwise directions, the mixing of the secondary fuel 314 and the compressed air 208 is further improved in the mixing tube 416. The plurality of outer vortex generators 506 and the plurality of inner vortex generators 606 also enhance the mixing of the secondary fuel 314 and the compressed air 208.

The outer span length of each outer flow guide 310 is larger than the inner span length of each inner flow guide 312 such that the flow area in the outer space 318 is larger than the flow area in the inner space 316. The quantity of the outer flow guides 310 is more than the quantity of the inner flow guides 312. The span length, the shell diameters, the quantity of the flow guides, and other parameters are selected such that there is a residual swirl remaining at the exit of the secondary fuel injector 300 in the direction generated by the flow through the outer space 318. Other constructions may reverse the residual swirl remaining at the exit of the secondary fuel injector 300 in the direction generated by the flow through the inner space 316.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

LISTING OF DRAWING ELEMENTS

100: gas turbine engine
102: compressor section
104: combustion section
106: turbine section
108: longitudinal axis
110: compressor stage
112: stationary vane
114: rotating blade
116: rotor
118: inlet section
120: combustor
122: exhaust gas
124: turbine stage
126: stationary turbine vane
128: rotating turbine blade
130: turbine inlet
132: exhaust portion
134: control system
200: combustion section
202: combustor
204: casing
206: compressor exit diffusor
208: compressed air
210: head-end section
212: transition duct
214: primary fuel injector
216: primary fuel supply tube
218: pilot burner
220: exhaust gas
222: combustion chamber
224: transition duct liner
226: opening
300: secondary fuel injector
302: fuel supply tube
304: outer shell
306: inner shell
308: central hub
310: outer flow guide
312: inner flow guide
314: secondary fuel
316: inner space
318: outer space
320: central axis
402: outer wall
404: inner wall
406: first side wall
408: second side wall
410: hollow outer shell interior
412: hollow outer flow guide interior
414: hollow inner flow guide interior
416: mixing tube
418: purge air channel
502: outer flow guide pressure side wall
504: outer flow guide suction side wall
506: outer vortex generator
508: outer flow guide fuel outlet
602: inner flow guide pressure side wall
604: inner flow guide suction side wall
606: inner vortex generator
608: inner flow guide fuel outlet

What is claimed is:

1. A combustor comprising:

a transition duct comprising a transition duct liner defining an opening that extends through the transition duct liner; and a secondary fuel injector disposed in the opening, the secondary fuel injector comprising:

an inner shell arranged to define an inner space;

an outer shell cooperating with the inner shell to define an outer space that is annular;

a plurality of inner flow guides positioned within the inner space and arranged around the inner shell, each inner flow guide of the plurality of inner flow guides arranged to turn a first mixture of fuel and air in one of a clockwise and counterclockwise direction around the inner shell; and a plurality of outer flow guides positioned within the outer space and arranged around the inner shell, each outer flow guide of the plurality of outer flow guides arranged to turn a second mixture of fuel and air in the other of the clockwise and counterclockwise direction around the inner shell, wherein each inner flow guide of the plurality of inner flow guides comprises an airfoil shape having an inner flow guide pressure side wall and an inner flow guide suction side wall, and wherein the inner flow guide pressure side wall defines an inner flow guide fuel outlet.

2. The combustor of claim 1, wherein the secondary fuel injector comprises a plurality of inner vortex generators, and wherein one inner vortex generator of the plurality of inner vortex generators is attached to the inner flow guide suction side wall.

3. The combustor of claim 1, wherein each outer flow guide of the plurality of outer flow guides comprises an airfoil shape having an outer flow guide pressure side wall and an outer flow guide suction side wall.

4. The combustor of claim 3, wherein the outer flow guide pressure side wall defines an outer flow guide fuel outlet.

5. The combustor of claim 3, wherein the secondary fuel injector comprises a plurality of outer vortex generators, and wherein one outer vortex generator of the plurality of outer vortex generators is attached to the outer flow guide suction side wall.

6. The combustor of claim 1, wherein each inner flow guide of the plurality of inner flow guides has an inner span length, wherein each outer flow guide of the plurality of outer flow guides has an outer span length, and wherein the inner span length is less than the outer span length.

7. The combustor of claim 1, wherein the outer shell defines a hollow outer shell interior to provide the fuel to the plurality of outer flow guides.

8. The combustor of claim 1, wherein each inner flow guide of the plurality of inner flow guides is in flow connection with one outer flow guide of the plurality of outer flow guides.

9. The combustor of claim 1, wherein a quantity of the outer flow guides is more than a quantity of the inner flow guides.

10. The combustor of claim 1, wherein the secondary fuel injector comprises a central hub disposed at a center of the inner space, wherein the central hub comprises a radius that is between 10% to 90% of the inner shell, and wherein the plurality of the inner flow guides are positioned between the central hub and the inner shell.

11. A combustor comprising:

a transition duct comprising a transition duct liner defining an opening that extends through the transition duct liner; and a secondary fuel injector disposed in the opening, the secondary fuel injector comprising:

an inner shell arranged to define an inner space;

an outer shell cooperating with the inner shell to define an outer space that is annular;

a plurality of inner flow guides positioned within the inner space and arranged around the inner shell, the plurality of inner flow guides arranged to turn a first mixture of fuel and air in one of a clockwise and counterclockwise direction around the inner shell, each inner flow guide of the plurality of inner flow guides comprising an airfoil shape having an inner flow guide pressure side wall and an inner flow guide suction side wall; and a plurality of outer flow guides positioned within the outer space and arranged around the inner shell, the plurality of outer airfoils arranged to turn a second mixture of fuel and air in the other of the clockwise and counterclockwise direction around the inner shell, each outer flow guide of the plurality of outer flow guides comprising an airfoil shape having an outer flow guide pressure side wall and an outer flow guide suction side wall, wherein the outer flow guide pressure side wall defines an outer flow guide fuel outlet.

12. The combustor of claim 11, wherein the inner flow guide pressure side wall defines an inner flow guide fuel outlet.

13. The combustor of claim 11, wherein the secondary fuel injector comprises a plurality of inner vortex generators, and wherein one inner vortex generator of the plurality of inner vortex generators is attached to the inner flow guide suction side wall.

14. The combustor of claim 11, wherein the secondary fuel injector comprises a plurality of outer vortex generators, and wherein one outer vortex generator of the plurality of outer vortex generators is attached to the outer flow guide suction side wall.

15. The combustor of claim 11, wherein each inner flow guide of the plurality of inner flow guides has an inner span length, wherein each outer flow guide of the plurality of outer flow guides has an outer span length, and wherein the inner span length is less than the outer span length.

16. The combustor of claim 11, wherein the outer shell defines a hollow outer shell interior to provide the fuel to the plurality of outer flow guides.

17. The combustor of claim 11, wherein each inner flow guide of the plurality of inner flow guides is in flow connection with one outer flow guide of the plurality of outer flow guides.

18. A combustor comprising:

a transition duct comprising a transition duct liner defining an opening that extends through the transition duct liner; and a secondary fuel injector disposed in the opening, the secondary fuel injector comprising:

an inner shell arranged to define an inner space;

an outer shell cooperating with the inner shell to define an outer space that is annular;

a plurality of inner flow guides positioned within the inner space and arranged around the inner shell, each inner flow guide of the plurality of inner flow guides arranged to turn a first mixture of fuel and air in one of a clockwise and counterclockwise direction around the inner shell; and a plurality of outer flow guides positioned within the outer space and arranged around the inner shell, each outer flow guide of the plurality of outer flow guides arranged to turn a second mixture of fuel and air in the other of the clockwise and counterclockwise direction around the inner shell, wherein the outer shell defines a hollow outer shell interior to provide the fuel to the plurality of outer flow guides.

19. A combustor comprising:

a transition duct comprising a transition duct liner defining an opening that extends through the transition duct liner; and a secondary fuel injector disposed in the opening, the secondary fuel injector comprising:

an inner shell arranged to define an inner space;

an outer shell cooperating with the inner shell to define an outer space that is annular;

a plurality of inner flow guides positioned within the inner space and arranged around the inner shell, each inner flow guide of the plurality of inner flow guides arranged to turn a first mixture of fuel and air in one of a clockwise and counterclockwise direction around the inner shell; and a plurality of outer flow guides positioned within the outer space and arranged around the inner shell, each outer flow guide of the plurality of outer flow guides arranged to turn a second mixture of fuel and air in the other of the clockwise and counterclockwise direction around the inner shell, wherein each inner flow guide of the plurality of inner flow guides is in flow connection with one outer flow guide of the plurality of outer flow guides.

* * * * *